US005399271A

United States Patent [19]

Puchta et al.

[11] Patent Number: 5,399,271

[45] Date of Patent: Mar. 21, 1995

[54] PREPARATION FOR TREATING WASHED LAUNDRY IN A TUMBLE DRYER

[75] Inventors: Rolf Puchta, Haan; Peter Sandkuehler, Hilden; Jutta Schreiber, Mettman; Theodor Voelkel, Erkrath, all of Germany

[73] Assignee: Henkel Kommanditgesellschaft auf Aktien, Duesseldorf, Germany

[21] Appl. No.: 190,137

[22] PCT Filed: Jul. 27, 1992

[86] PCT No.: PCT/EP92/01701

§ 371 Date: Feb. 3, 1994

§ 102(e) Date: Feb. 3, 1994

[87] PCT Pub. No.: WO93/03132

PCT Pub. Date: Feb. 18, 1993

[30] Foreign Application Priority Data

Aug. 3, 1991 [DE] Germany ..... 41 25 847.9

[51] Int. Cl.[6] ..... D06M 10/08

[52] U.S. Cl. ..... 252/8.6; 252/8.9; 428/262

[58] Field of Search ..... 252/8.6, 8.9; 428/262; 106/271

[56] References Cited

U.S. PATENT DOCUMENTS

| | | | |
|---|---|---|---|
| 4,209,549 | 6/1980 | Murphy et al. | 427/11 |
| 5,300,238 | 4/1994 | Lin et al. | 252/8.6 |

FOREIGN PATENT DOCUMENTS

| | | |
|---|---|---|
| 2249207 | 3/1975 | France . |
| 1965470 | 7/1970 | Germany . |
| 1955803 | 5/1971 | Germany . |
| 2516104 | 10/1975 | Germany . |
| 2700512 | 7/1977 | Germany . |
| 3003249 | 8/1981 | Germany . |
| 9206174 | 4/1992 | WIPO . |

*Primary Examiner*—Mark L. Bell
*Assistant Examiner*—C. M. Bonner
*Attorney, Agent, or Firm*—Ernest G. Szoke; Wayne C. Jaeschke; Real J. Grandmaison

[57] ABSTRACT

An article for treating washed laundry in a tumble dryer to provide the laundry with a pleasant, soft and full feel, and antistatic properties. The article is a flexible sheet-form substrate coated with a mixture of (a) a fatty component selected from a fatty acid mono-, di-, and triglyceride, a fatty acid and a fatty alcohol, and (b) a fatty acid ester of a monohydric alcohol.

15 Claims, No Drawings

PREPARATION FOR TREATING WASHED LAUNDRY IN A TUMBLE DRYER

BACKGROUND OF THE INVENTION

1. Field of the Invention

This invention relates to a preparation for treating washed laundry in a tumble dryer consisting of a flexible sheet-form material coated with a mixture of active substances for treating laundry.

With the development of automatic tumble dryers, in which washed laundry is dried by heated air, it became possible to carry out the treatment of laundry generally effected during the final rinse cycle of a washing machine in a tumble dryer. The object of treating washed laundry in this way is generally to give the laundry a pleasant soft and full feel, anti-electrostatic properties and an agreeable fragrance. Whereas, in the treatment of laundry in the final rinse cycle, it had always been necessary to use active substances which were completely transferred to the fabrics to be treated in the aqueous wash liquor, the shift of the treatment process to a tumble dryer made it possible to use active substances that were difficult or even impossible to use in aqueous wash liquors. Although, in principle, active substances different from those used in the final rinse cycle can be used in the treatment of laundry in a tumble dryer, the active substances used in the final rinse treatment, namely quaternary ammonium compounds containing 1, 2 or 3 long groups in the molecule derived from ammonia or imidazoline, have hitherto also been used almost exclusively in the treatment of laundry in a tumble dryer. The reason for this is that quaternary ammonium compounds such as these can be synthesized relatively easily and, above all, are extremely effective as fabric softeners.

2. Discussion of Related Art

Various proposals have been put forward for the application of fabric softeners to fabrics in a tumble dryer. For example, it has been proposed to transfer the active substances to the laundry, if desired together with additional auxiliaries, from rigid containers added to the laundry in the tumble dryer. In addition to rigid containers, flexible containers, for example bags, filled with the active substances have also been proposed. However, the most simple and, hence, generally the most common option is the release of the active substances from flexible sheet-form materials. The treatment of laundry in a tumble dryer by flexible sheet-form materials impregnated with active substances is described, for example, in German patent application DE-A 19 55 803. However, depending on the type of sheet-form textile used for impregnation with the active substance, the problem arises that, in the case of substrates having a low adsorption capacity, the fatty active substances are unevenly transferred to the fabrics and leave greasy marks thereon. Other substrate materials of high adsorption capacity, such as for example sponge cloths or foam sheets, do not provide for an adequate release of the active substances so that, where they are used as carriers for the active substances, losses of active substances are incurred in the form of unused active substances.

According to the teaching of DE-A 19 65 470, the disadvantages described above can be overcome by using substrates of medium adsorption capacity as carriers for the quaternary ammonium compounds. However, it was subsequently found that, under certain conditions, it is even possible to use substrates of low adsorption capacity, which have the advantage of high active-substance release, without any marks being left on the laundry. Preparations for the treatment of washed laundry in a tumble dryer, of which the carriers for the fabric softeners include a substrate of low adsorption capacity, are the subject of DE-A 30 03 249.

According to the teaching of DE-A 27 00 512,up to 60% of the softening quaternary ammonium compounds can be replaced by fatty acid esters of a polyhydric alcohol. This has the advantage that the substrates used as carriers for the fabric softeners are not required to have a specific adsorption capacity.

Laundry treatment preparations for use in tumble dryers, of which the active substances are free from quaternary ammonium compounds, are also known. For example, DE-A 25 16 104 describes products of which the active component consists completely or partly of sorbitan esters. However, in the same way as the quaternary ammonium compounds, sorbitan esters cause staining or are characterized by an inadequate release of active substance unless materials of medium adsorption capacity are used as the substrate.

Other fabric softening agents which do not contain any quaternary ammonium compounds are the fatty acid esters of polyhydric alcohols known, for example, from DE 27 00 512. According to the teaching of this patent application, however, they have to be used in conjunction with appreciable quantities (40 to 95% by weight) of cationic fabric softeners of the quaternary ammonium compound type. However, it has recently been found that, on account of their more or less pronounced toxic properties and their poor biodegradability, quaternary ammonium compounds pollute the wastewater which they enter on completion of the rinse cycle or together with the wash liquor of the washing process following the aftertreatment. Accordingly, the problem addressed by the present invention was to provide fabric-softening mixtures for the treatment of washed laundry in a tumble dryer, the mixtures being released and transferred to the fabrics to be treated without staining and at a high rate from a flexible sheet-form material serving as carrier for the active substances and the mixtures being free from quaternary ammonium compounds. Another problem addressed by the invention was to provide a fabric softener or mixture of fabric softeners which, in the production process, would solidify rapidly, i.e. at a relatively high temperature, after application to the flexible sheet-form material to form a layer with a dry feel and would provide the fabrics thus treated with good anti-electrostatic properties.

DESCRIPTION OF THE INVENTION

It has now surprisingly been found that fatty acid glycerides, which are unsuitable on their own as fabric softeners, can be combined with other fatty alcohol or fatty acid derivatives, likewise unsuitable on their own as fabric softeners, to form mixtures which do not have any of the above-mentioned disadvantages of known mixtures and which meet the other requirements mentioned.

Accordingly, the present invention relates to preparations for the treatment of washed laundry in a tumble dryer consisting of a flexible sheet-form material coated with mixtures of active substances for the treatment of laundry, the mixtures containing a fatty component, characterized in that the fatty component a) comprising fatty acid mono-, di- or triglycerides and/or fatty acids and/or fatty alcohols is present in admixture with b) fatty alcohol alkoxylates and/or fatty acid esters of monohydric alcohols.

The constituents of the fatty component a) are known individually as fabric softeners, but on their own or even in combination with one another do not meet the requirements defined in detail in the description of the problem addressed by the invention. Thus, they are either difficult to process because they solidify too slowly or too quickly after application to the flexible sheet-form material; or they do not provide the fabrics thus treated with adequate softness or satisfactory anti-electrostatic properties; or the flexible sheet-form materials coated with them have an unpleasant feel which discourages the consumer from using them; or the active-substance release rate is too low. Accordingly, the fatty component a) is combined with a component b) consisting of fatty alcohol alkoxylates and/or fatty acid esters of monohydric alcohols in such a way that the active-substance mixtures formed begin to crystallize at a temperature of 40° C. or higher. In the context of the present patent application, the beginning of crystallization is determined by DSC measurement with a Mettler FP 84 differential scanning calorimeter. The mixture of active substances to be tested is heated at a rate of 2° C. per minute until the end-of-melting temperature is reached. During the subsequent cooling of the mixture, the heat of crystallization is released at the temperature at which crystallization begins. The temperature at which the heat of crystallization begins to be released is referred to hereinafter as the beginning of crystallization. Mixtures of components a) and b) suitable for the treatment preparations according to the invention begin to crystallize at a temperature of 40° C. or higher.

In one preferred embodiment, the active-substance mixtures contain a fatty component a) containing fatty acid monoglyceride and diglyceride, preferably fatty acid monoglycerides. The fatty acid component of these monoglycerides and diglycerides is derived from linear or branched fatty acids which may be saturated or unsaturated and which contain from 10 to 24 carbon atoms. A typical example of suitable glyceride mixtures is, for example, a mixture consisting of fatty acid mono and diglycerides which mainly contains fatty acid monoglyceride and of which the fatty acid component is derived from stearic acid. A glycerol mono-/dipalmitate/stearate containing 40 to 60% monoglyceride is also suitable.

A preferred embodiment of the preparation according to the invention contains fatty acids having a melting point in the range from 40° C. to 80° C. and preferably in the range from 45° C. to 65° C. in the fatty component a). The fatty acids may be of natural and synthetic origin and are generally linear and, in particular, saturated. Natural fatty acids are derived from triglycerides, for example from coconut oil, palm kernel oil, olive oil, or even from animal fats, such as beef tallow, fish oil or lard. Commensurate with their provenance, the fatty acids derived therefrom are mixtures of different fatty acids and are also preferred if they have a melting point, optionally after hydrogenation, in the range from 40° C. to 80° C. and more particularly in the range from 45° C. to 65° C.

In addition to the fatty acid glycerides or fatty acids already mentioned, the fatty component a) may also contain fatty alcohols. Preferred fatty alcohols for the preparations according to the invention contain 10 to 22 carbon atoms in the molecule. The provenance of the fatty alcohols may be the same as mentioned above for the fatty acids. In other words, the fatty alcohols may also be of synthetic or natural origin and, optionally after hydrogenation, may be mixtures of different fatty alcohols. Fatty alcohols containing 10 to 22 carbon atoms are preferred.

The fatty alcohol alkoxylates suitable for component b) are generally based on the fatty alcohols also suitable for the fatty component a). They contain 1 to 15 moles of ethylene oxide and/or 1 to 15 moles of propylene oxide per mole of fatty alcohol. Fatty alcohol alkoxylates, in which ethylene oxide and propylene oxide are simultaneously added onto the fatty alcohol, are preferred. More particularly, suitable fatty alcohol alkoxylates contain 2 to 8 moles of ethylene oxide and/or propylene oxide per mole of fatty alcohol.

In addition to fatty alcohol alkoxylates, component b) may contain fatty acid esters of monohydric alcohols. Preferred fatty acid esters of monohydric alcohols contain a total of 15 to 44 carbon atoms. Suitable monohydric alcohol components are, in particular, methyl alcohol, ethyl alcohol, n-propyl alcohol and isopropyl alcohol. The foregoing observations in respect of the fatty acids also apply to the fatty acid component of suitable fatty acid esters of monohydric alcohols. In the context of the invention, fatty acid esters of monohydric alcohols are also understood to include fatty acid ester mixtures of different composition, including for example the carnauba wax obtainable from the leaves of the Brazilian fan palm Copernica prunivera, the candelilla wax obtained from the leaves of Euphorbiaceae, jojoba oil and natural or synthetic beeswax. A suitable synthetic beeswax is, for example, a mixture containing 40 parts by weight of a fatty acid monoglyceride, of which the acid component is a 3:1 mixture of hydroxystearic acid and hydrogenated castor oil, 35 parts by weight of palmitic acid cetyl ester, 20 parts by weight of microwax, 10 parts by weight of hydroxystearic acid and other constituents in small quantities. Natural ester mixtures such as these are also regarded as fatty acid esters of monohydric alcohols in the context of the present invention.

To ensure that they have the preferred beginning of crystallization at a temperature of 40° C. or higher, the active-substance mixtures consist of component a) and component b) in a ratio by weight of 3:1 to 1:3 and preferably in a ratio by weight of 2:1 to 1:2. Preparations according to the invention in which the mixtures contain component a) and component b) in the ratio by weight mentioned are preferred. Occasionally, it can be useful to modify the beginning of crystallization by additions of organic solvents. The addition of an effective quantity of glycerol, generally amounting to between 1 and 15% by weight, based on the active-substance mixtures, is particularly suitable for this purpose.

Although, in principle, the flexible sheet-form material used as carrier for the mixture of active substances may contain a sufficient quantity of the mixtures for one application or even for several applications, the preparations preferably contain a quantity of component a)+b) sufficient for one application. This quantity is preferably 1 to 5 g and is applied to one or both sides of the flexible sheet-form material.

For application to the flexible sheet-form material, the mixtures of active substances are liquefied by heating. Particularly suitable mixtures have a viscosity at 60° C. of 5 to 100 mPas and are therefore preferred.

By virtue of the fact that the constituents of the active-substance mixtures of the preparations according to the invention do not contain significant amounts of flammable liquids by virtue of their origination from natural and renewable raw materials, the flash point of the mixtures is distinctly higher than that of the mixtures generally used for the known preparations for the treatment of washed laundry in a tumble dryer. This is another advantage of the preparations according to the invention. Accordingly, preparations according to the invention of which the active-substance mixtures have a flashpoint above 55° C. and preferably above 100° C. are particularly preferred. A flashpoint as high as this has a particularly favorable effect in the production of the preparations according to the invention where the mixtures of active substances are applied to the flexible sheet-form material at elevated temperature.

The flexible sheet-form material used for the preparations according to the invention may be a fibrous sheet-form material and, accordingly, may be a woven or knitted textile material or even a nonwoven material. Foam-like or sponge-like materials of natural or synthetic origin, such as for example foamed synthetic polymers preferably present in sheet form, are also suitable as the flexible sheet-form materials. The flexible sheet-form materials generally have a lower adsorption capacity than the foam-like or sponge-like materials. The lower adsorption capacity is usually associated with a high release rate of the active-substance mixtures whereas the foam-like or sponge-like materials, although capable of absorbing more active-substance mixture, generally do not release it as completely in the tumble dryer. Textile flexible sheet-form materials above all and especially nonwovens have proved to be particularly successful. Compared with the sponge-like or foam-like materials, they have a low to medium adsorption capacity and are preferred for the preparations according to the invention. Flexible sheet-form materials in the form of a nonwoven of synthetic and natural fibers are particularly preferred carriers for the active-substance mixtures.

Although the preparations according to the invention do not contain any salt-like constituents, such as quaternary ammonium salts for example, in their active-substance mixtures, the fabrics treated with the preparations according to the invention show surprisingly good anti-electrostatic properties after treatment in a tumble dryer at temperatures in the range from about 50° to 80° C. In addition, the preparations according to the invention are convincing in the sum total of the desirable properties present. They are easy to produce, do not have an unpleasant feel after their production, are capable of almost completely releasing the mixtures of active substances and transferring them to the fabrics to be treated in the tumble dryer and provide the fabrics to be treated with a pleasant soft and full feel and with excellent anti-electrostatic properties. Since in addition the mixtures of active substances are free from quaternary ammonium compounds, environmental pollution by the active substances entering the receiving waters with the washing water of the washing process following the treatment in the tumble dryer is minimal in the extreme. Another advantage of the preparations according to the invention lies in the fact that the components present in the active-substance mixtures are made from natural and renewable raw materials.

In addition to the constituents mentioned in the foregoing, the mixtures of active substances may also contain auxiliaries and additives typical of preparations for the treatment of washed laundry in a tumble dryer, including for example fragrances, dyes, heavy metal complexing agents, clay materials or fine-particle silica.

EXAMPLES

Quantities of 3 g of active-substance mixtures having the following two compositions A and B were uniformly applied to 14 cm×25 cm pieces of a random-fiber nonwoven consisting of polyester and cellulose fibers ("Keybak 02", a product of Chicopee, Netherlands).

| Composition (%) | A | B |
|---|---|---|
| Glycerol monostearate containing 60% monoglyceride | 47 | 47 |
| $C_{10/14}$-fatty alcohol + 1.2 moles of propylene oxide + 6.4 moles of ethylene oxide | 41 | — |
| Isopropyl stearate | — | 46 |
| Beeswax substitute | 5 | — |
| Perfume oil | 7 | 7 |

The beginning of crystallization was at 42° C. for mixture A and at 46° C. for mixture B. For commercial 75% by weight distearyl dimethyl ammonium chloride (DSDMAC) containing the same quantity of perfume oil, the beginning of crystallization was at 27° C.

The flashpoint was 166° C. for mixture A, 156° C. for mixture B and 28° C. for the DSDMAC mixture. Accordingly, the DSDMAC mixture has to be handled as a hazardous material whereas mixtures A and B of the preparations according to the invention do not. In every case, correspondingly treated fabrics had substantially the same soft feel.

The anti-electrostatic properties, measured as the dissipation half-time of an applied electrical charge, amounted to 7.6 seconds (A), 10.6 seconds (B) and 36 seconds (DSDMAC).

In every case, the release of active substance was substantially complete (>96% release rate).

Despite the use of a carrier material having the relatively low adsorption capacity of around 6,as measured by the method described in U.S. Federal Specification UU-T-595 b and modified in accordance with DE-A 27 00 512, the treated textiles did not show any stains.

The toxicological, ecological and ecotoxicological behavior of mixtures A and B was better in every respect than that of DSDMAC.

We claim:

1. An article for the treatment of washed laundry in a tumble dryer, said article comprising a fibrous flexible sheet-form substrate coated with a mixture of (a) a fatty component selected from the group consisting of a fatty acid mono-, di-, and tri-glyceride, a fatty acid and a fatty alcohol, and (b) a fatty acid ester of a monohydric alcohol.

2. An article according to claim 1 wherein said mixture of component (a) and component (b) has a crystallization temperature of 40° C. or higher.

3. An article according to claim 1 wherein said fatty component (a) consists essentially of fatty acid monoglyceride and diglyceride.

4. An article according to claim 1 wherein said fatty component (a) contains fatty acids having a melting point of from 40° C. to 80° C.

5. An article according to claim 1 wherein said fatty component (a) contains $C_{10}$–$C_{22}$ fatty alcohols.

6. An article according to claim 1 wherein said fatty acid ester of a monohydric alcohol contains a total of 15 to 44 carbon atoms.

7. An article according to claim 1 wherein said component (a) and said component (b) are present in a weight ratio of 3:1 to 1:3.

8. An article according to claim 1 wherein said substrate contains from 1 to 5 grams of said mixture of component (a) and component (b).

9. An article according to claim 1 wherein said mixture of component (a) and component (b) has a viscosity of from 5 to 100 mPas at 60° C.

10. An article according to claim 1 wherein said mixture of component (a) and component (b) has a flash point above 55° C.

11. An article according to claim 1 wherein said substrate is selected from the group consisting of a woven or knitted textile material, and a nonwoven synthetic or natural fiber material.

12. An article for the treatment of washed laundry in a tumble dryer, said article comprising a fibrous flexible sheet-form substrate coated with a mixture of (a) a fatty component selected from the group consisting of a fatty acid mono-, di-, and tri-glyceride, a fatty acid and a fatty alcohol, and (b) a fatty acid ester of a monohydric alcohol, wherein said mixture of component (a) and component (b) has a crystallization temperature of 40° C. or higher.

13. An article according to claim 12 wherein said component (a) and said component (b) are present in a weight ratio of 3:1 to 1:3.

14. An article according to claim 12 wherein said substrate contains from 1 to 5 grams of said mixture of component (a) and component (b).

15. An article according to claim 12 wherein said substrate is selected from the group consisting of a woven or knitted textile material, and a nonwoven synthetic or natural fiber material.

* * * * *